United States Patent [19]

Tadych

[11] Patent Number: 4,848,659

[45] Date of Patent: Jul. 18, 1989

[54] ELECTRIC STRIPPER APPLICATOR

[75] Inventor: John E. Tadych, Franklin, Wis.

[73] Assignee: American Building Restoration Chemicals, Inc., Franklin, Wis.

[21] Appl. No.: 59,403

[22] Filed: Jun. 8, 1987

[51] Int. Cl.[4] ..... B05B 9/043

[52] U.S. Cl. ..... 239/127; 239/146; 239/722; 418/201

[58] Field of Search ..... 239/1, 127, 146, 172, 239/332, 722; 222/318, 383; 418/104, 131, 201

[56] References Cited

U.S. PATENT DOCUMENTS

| | | | |
|---|---|---|---|
| 2,045,164 | 6/1936 | Richards | 239/127 |
| 2,201,736 | 5/1940 | McGrew | 239/332 X |
| 2,623,469 | 12/1952 | Gray | 418/201 X |
| 2,745,643 | 5/1956 | Kleinlein | 418/201 X |
| 2,808,048 | 10/1957 | Garrison | 239/127 X |
| 3,248,020 | 4/1966 | Spalding | 222/318 X |
| 3,288,077 | 11/1966 | Meskat | 418/201 X |
| 3,575,348 | 4/1971 | MacKay | 239/127 |
| 3,940,065 | 2/1976 | Ware et al. | 239/127 X |
| 4,699,575 | 10/1987 | Geisel et al. | 418/131 X |

FOREIGN PATENT DOCUMENTS

| | | | |
|---|---|---|---|
| 835511 | 6/1981 | U.S.S.R. | 239/146 |

*Primary Examiner*—Andres Kashnikow
*Attorney, Agent, or Firm*—Paul R. Puerner

[57] ABSTRACT

A stripper applicator employs a positive displacement gear pump to spray high viscosity stripper materials. The gear pump is driven at a reduced speed by an electric motor. A pressure relief valve is inserted in the outlet port of the gear pump to adjust the delivery pressure of the liquid. A large diameter suction line draws the liquid from a container to the pump without priming, and a dump line returns overflow liquid from the relief valve to the container. The stripper applicator is capable of delivering 1.5 gallons per minute of liquid at relatively low pressure to the delivery hose, which terminates in a spray gun. The electric motor and gear pump are mounted to a portable and light weight chassis.

6 Claims, 2 Drawing Sheets

ELECTRIC STRIPPER APPLICATOR

BACKGROUND OF INVENTION

1. Field of the Invention..

This invention pertains to fluid handling, and more particularly to apparatus for pumping high viscosity liquids.

2. Description of the Prior Art

Various equipment has been developed to spray liquids. For example, equipment for spraying coatings such as paint, lacquer, and anti-rust compounds is well known. Such coatings usually have relatively low viscosities, and conventional airless pumping units that operate on a hydraulic ram principle are entirely satisfactory.

However, such pumping units are not acceptable for spraying thick viscous liquids such as stripper materials. One well known grade of stripper has a viscosity of approximately 100,000 SSU, which is the consistency of lard. Although airless pumping units are occasionally used to spray viscous strippers, such use is a misapplication of the equipment. That is primarily because the units must be operated at pressures as high as 1000 PSI and even 3,000 PSI to enable them to pump the thick stripper. At such high pressures, there is great danger of a leak occurring somewhere in the system. The resulting jet of high pressure caustic material is extremely dangerous to nearby personnel. Further, the air compressor or five-to-one or ten-to-one pressure pump required to produce the necessary high pressures is expensive, thereby increasing capital expenditures. In addition, such high pressure machinery is bulky and cumbersome to work around at the job site.

There are pumps that transfer viscous fluids but not in a spray pattern. Pumps that do not create enough pressure produce a spray pattern that would be of no value when applying viscous paint strippers to an overhead or vertical surface.

Thus, a need exists for improved apparatus for spraying high viscosity liquids.

SUMMARY OF THE INVENTION

In accordance with the present invention, an inexpensive and convenient stripper applicator is provided that safely pumps high viscosity caustic fluids. This is accomplished by apparatus that includes a positive displacement pump operated at low pressures and low speeds to reliably transfer large volumes of fluid.

The stripper applicator pump is preferably a gear pump having helical gears that are driven at the relatively slow speed of approximately 600 RPM. An electric motor or gasoline powered engine may be employed to drive the pump gears. In either case, a speed reducing unit is inserted between the prime move and the gear pump. Various seal materials are interchangeably used to enable the pump to handle different types of chemicals. The gears are mounted for rotation on self-lubricating carbon bearings to assure long service life.

The stripper applicator pump is supplied with an adjustable pressure relief valve. The pressure relief valve is typically set at only about 375 to 400 PSI.

The stripper applicator further includes three lines for efficiently transferring the fluid with minimum pressure losses. A relatively short length of large diameter suction hose enables the pump to draw the chemical from a nearby container. A long and large diameter but light weight delivery hose directs the liquid from the outlet of the pressure relief valve to the point of application. A third line is connected to the dump port of the relief valve. The free end of the third hose is placed in the fluid supply container for returning overflow from the valve to the container. At a pressure of approximately 400 PSI and 600 RPM gear pump speed, the stripper applicator of the present invention is capable of spraying approximately 1.5 gallons of viscous stripper per minute.

Further in accordance with the present invention, the stripper applicator is designed and manufactured as a self-contained and portable assembly. The gear pump with pressure relief valve, speed reducer unit, and prime mover are compactly mounted on a wheeled chassis. With a one horsepower electric motor as the prime mover, the entire stripper applicator weighs only about 70 pounds.

Other objects, aims, and advantages of the invention will become apparent to those skilled in the art upon reading the detailed disclosure.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
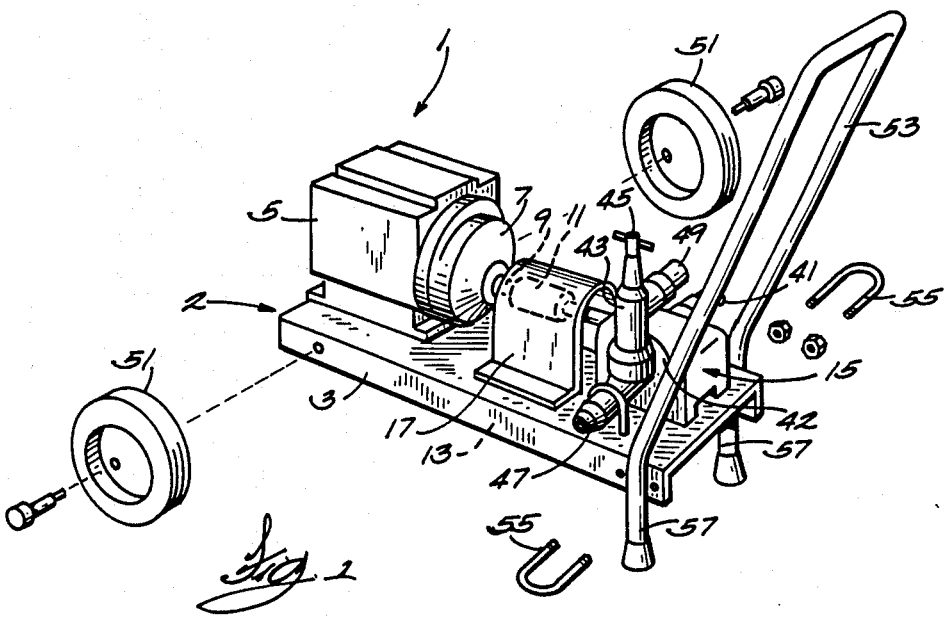
FIG. 1 is an exploded perspective view of the stripper applicator of the present invention.
Figure 2:
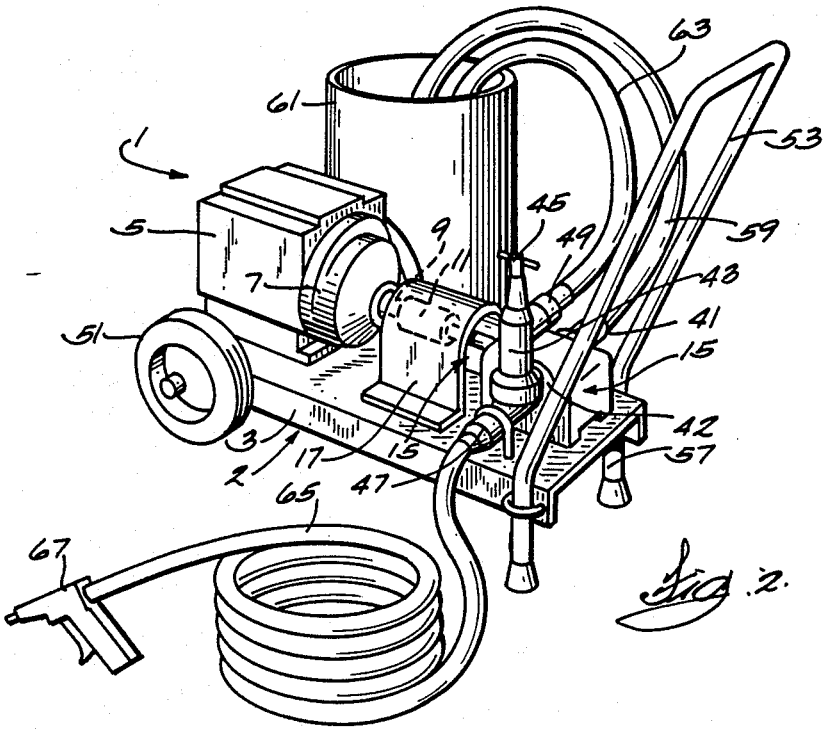
FIG. 2 is a perspective view of the stripper applicator of the present invention showing the hoses in place.

Referring to FIGS. 1 and 2, a stripper applicator 1 is illustrated that includes the present invention. The stripper applicator is particularly useful for spraying high viscosity stripping solutions to selected surfaces. However, it will be understood that the invention is not limited to handling stripper solutions; the stripper applicator 1 is capable of efficiently pumping grease, high viscosity oils, mineral based water-proof sealants, gel type substances, and thick food products such as molasses.

In the illustrated construction, the stripper applicator 1 comprises a chassis 2 including a base plate 3, to which is mounted a prime mover 5. The prime mover 5 may be an electric motor or a gasoline powered engine; an electric motor is preferred and illustrated. The electric motor is furnished with a standard male electrical socket and an on/off control switch, not shown. To the electric motor is mounted a speed reducer 7. Preferably, the speed reducer 7 has a 6:1 ratio that reduces the speed of the motor output shaft (not illustrated) from 3,600 RPM to 600 RPM. The speed reducer output shaft 9 is connected by a flexible coupling 11 to the shaft 13 of a positive displacement gear pump 15. A guard 17 surrounds the rotating shafts 9 and 13 and coupling 11 The pump 15 and guard 17 are secured to the base plate 3.

Figure 3:
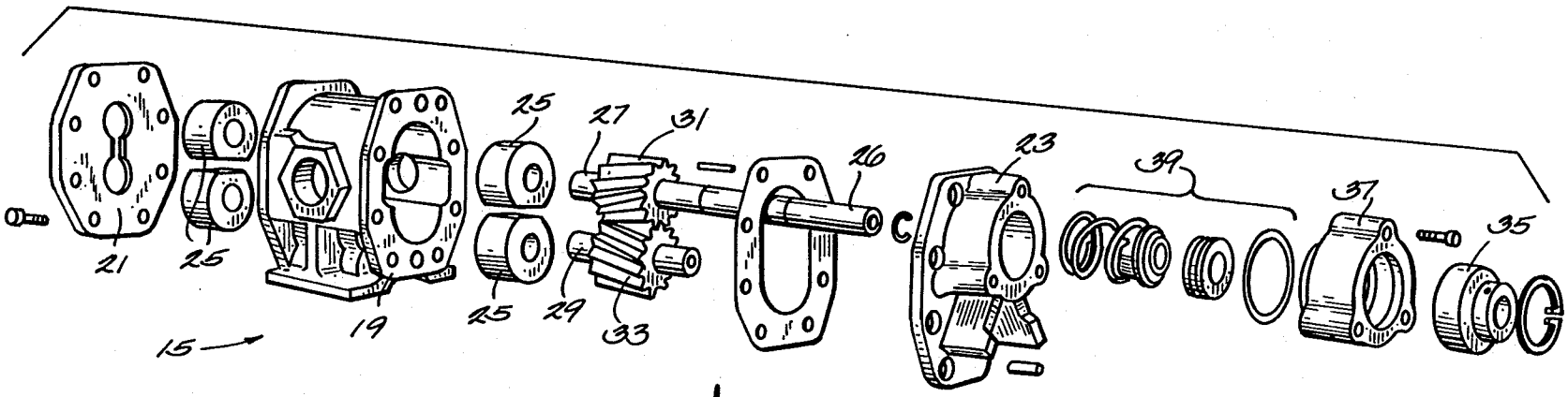
FIG. 3 is an exploded view of the gear pump employed with the present invention.

The gear pump 15 preferably has a construction as best illustrated in FIG. 3. A housing 19 with end plates 21 and 23 support carbon self-lubricated bearings 25.

Rotatably mounted in the bearings 25 are a pair of shafts 27 and 29 to which are fixed meshing helical gears 31 and 33 respectively. The outboard end 26 of the shaft 27 is supported by a permanently sealed ball bearing 35 that is mounted within a bearing retainer 37. The bearing retainer 37 in turn is mounted to the end plate 23. A chemically resistant seal assembly 39 separates the bearing 35 from the interior of the housing 19. The seals of the assembly 39 may be made of Viton, Buna N, or teflon, depending on the material to be pumped.

Returning to FIGS. 1 and 2, the gear pump 15 has an inlet port 41 and an outlet port 42. Inserted in the pump outlet 42 is a pressure relief valve 43. The pressure relief valve 43 is manually adjustable by means of a handle 45. The relief valve has an outlet port 47 and a dump port 49.

The stripper applicator 1 of the present invention further comprises a short suction hose 59 that is coupled snugly to the pump inlet port 41. The hose 59 is of relatively large diameter. The free end of the suction hose is equipped with a screen, not illustrated in FIG. 2. A second hose 63 is coupled to the dump port 49 of the relief valve 43. One end of a long delivery hose 65 is coupled to the outlet port 47 of the relief valve. The delivery hose 65 may be as long as 50 feet. The three hoses 59, 63, and 65 are preferably made of a cross linked polyethylene material, as that material resists attack by such caustic chemicals as methylene chloride and other stripping agents.

The free end of the delivery hose 65 is fit with a trigger operated spray gun 67. The spray gun 67 has an on/off ball valve with a teflon seat. A spring and clamp arrangement automatically blocks fluid flow when the operator releases the spray gun trigger. The gun nozzle is designed to create a variable round pattern through a ½ inch diameter orifice.

For convenient portability of the stripper applicator 1, wheels 51 are mounted to one end of the base plate 3. To the opposite end of the base plate is attached an upstanding handle 53. The handle 53 may be attached to the base plate by means of U-bolts and nuts 55, thereby completing the chassis 2. Preferably, the free ends 57 of the handle 53 extend below the base plate such that when resting on the ground, they cooperate with the wheels 51 to maintain the base plate approximately level. The entire stripper applicator 1 is thereby portable and convenient to use. The total weight is only about 70 pounds, which is light enough to be placed on a scaffold or swing stage.

To use the stripper applicator 1 of the present invention, it is located proximate the job site. Its light weight and portability enable it to be positioned in almost any convenient place relative to the surfaces to be sprayed. The electric motor 5 is plugged into a standard source of 110 volt electric power, but the control switch is left in the off position. The pump 15 is pre-lubricated or primed by injecting light oil, water, or diluted stripping material into the inlet port 41 before the suction hose 59 is connected to the inlet port. The free end of the suction hose is placed within a container 61 of the material to be sprayed. The free end of the dump hose 63 is also inserted into the container 61. Before turning on the motor, the operator dons protective clothing, including face shield, pants, jacket, and boots. When the motor is energized, the gear pump draws the viscous liquid from the container to the pump through the suction line. Initial priming may be hastened by diluting the first portion of the stripper material, but such priming is not necessary. The pump is capable of operating at 17.7 inches of mercury vacuum. The pump speed of 600 RPM enables the pump to handle the thick liquids without cavitating. Nevertheless, with the pressure relief valve 43 set at approximately 400 PSI by means of the handle 45, the pump can deliver approximately 1.5 gallons per minute of a stripper material having a viscosity as high as 100,000 SSU. The pump bearings 25 are lubricated by the fluid being pumped, and the seal assembly 39 prevents the caustic fluid from escaping. The long length of the delivery hose 65 enables the operator to move freely about the job without hindrance from the chassis 2 and the components mounted on it.

Without further description, it is thought that the advantages to be gained from the disclosed embodiment of the invention will be apparent to those skilled in the art. Further, it is contemplated that various modifications and changes may be made to the stripper applicator of the present invention within the scope of the appended claims without departing from the spirit of the invention.

I claim:

1. An airless portable applicator for spraying caustic paint stripper material having a viscosity of approximately 100,000 SSU on a selected surface comprising:

a. a positive displacement pump comprising:
   i. a housing having an interior, a pair of opposed end plates, and inlet and outlet ports;
   ii. pairs of carbon self-lubricating bearings supported in spaced apart relationship in said housing and retained, respectively, by said opposed end plates;
   iii. gear means mounted in the carbon self lubricating bearing for rotation therein to pump the caustic paint stripper, the gear means including an input shaft;
   iv. bearing means for rotatably supporting the gear means input shaft; and
   v. caustic paint stripper resistant seal means assembled to the housing for separating the interior thereof from the input shaft bearing means;

b. electric motor means for driving the pump input shaft at a predetermined speed;

c. a pressure reducing valve for setting and maintaining the pressure of the pumped caustic paint stripper and having an inlet port connected to the pump outlet port, an outlet port, and a dump port;

d. A first flexible hose of caustic paint stripper resistant material connected to the pump inlet port for transferring the caustic paint stripper from a source thereof to the pump;

e. a second flexible hose of caustic paint stripper resistant material connected to the pressure reducing valve outlet port for delivering the caustic paint stripper to the selected surface; and f. a third flexible hose of caustic paint stripper resistant material connected to the pressure reducing valve dump port for returning caustic paint stripper to the source thereof from the pump.

2. The applicator of claim 1 wherein:

a. the electric motor means drives the pump input shaft at approximately 400 rpm; and b. the pressure reducing valve is set to maintain approximately 400 psi in the caustic paint stripper material delivered to the second flexible hose.

3. The applicator of claim 1 further comprising a stable chassis for mounting the pump and electric motor means thereon, the chassis comprising:

a. an elongated light weight base plate adapted to mount the electric motor means and the gear pump thereon;

b. a pair of wheels mounted to one end of the base plate; and c. handle means attached to the base plate second end for selectively supporting the plate second end on the ground and for raising the base plate second end off the ground to enable the chassis to be wheeled from place to place, the wheels and handle means being arranged to support the base plate a short distance off the ground to thereby provide a stable support for the electric motor means and the gear pump.

4. In combination with a container of caustic paint stripper having a viscosity of approximately 100,000 SSU, a low pressure electric stripper applicator remote and separate from the container for spraying the caustic paint stripper on a selected surface comprising:

a. a positive displacement pump comprising:

i. a housing having an interior, a pair of opposed end plated, and inlet and outlet ports;

ii. carbon self-lubricating bearings supported in the end plates;

iii. gear means mounted in the carbon self-lubricating bearings for rotation therein to pump the caustic paint stripper, the gear means including an input shaft;

iv. bearing means for rotatably supporting the gear means input shaft; and v. caustic paint stripper resistant seal means assembled to the housing for separating the interior thereof from the input shaft bearing means;

b. electric motor means for driving the pump input shaft at a predetermined speed;

c. a pressure reducing valve for setting and maintaining the pressure of the pumped caustic paint stripper and having an inlet port connected to the pump outlet port, an outlet port, and a dump port;

d. a first flexible hose of caustic paint stripper resistant material having a first end connected to the pump inlet port and a second end inserted in the container of caustic paint stripper;

e. a second flexible hose of caustic paint stripper resistant material connected to the pressure reducing valve outlet port for delivering the caustic paint stripper to the selected surface;

f. a third flexible hose of caustic paint stripper resistant material having a first end connected to the pressure reducing valve dump port and a second end inserted in the container of caustic paint stripper; and g. chassis means for mounting the gear pump and electric motor means thereto and for moving the electric stripper applicator from place to place independent of the container of caustic paint stripper.

5. The combination of claim 4 wherein:

a. the electric motor means drives the pump input shaft approximately 400 rpm; and b. the pressure reducing valve is set to maintain approximately 400 psi in the caustic paint stripper delivered to the second flexible hose.

6. The combination of claim 4 wherein the chassis means comprises:

a. an elongated light weight base plate adapted to mount the electric motor means and gear pump thereon;

b. a pair of wheels mounted to one end of the base plate; and c. handle means attached to the base plate second end for selectively supporting the base plate second end on the ground and for raising the base plate second end off the ground to enable the chassis to be wheeled from place to place, the wheels and handle means being arranged to support the base plate a short distance off the ground to thereby provide a stable support for the electric motor means and the gear pump.

* * * * *